US009463127B2

(12) United States Patent
Hochman et al.

(10) Patent No.: US 9,463,127 B2
(45) Date of Patent: Oct. 11, 2016

(54) TRANSPORTER TABLE SYSTEM

(71) Applicants: Leon Hochman, West Bloomfield, MI (US); Nancy Valvona, West Bloomfield, MI (US); Stephen Nicolato, West Bloomfield, MI (US)

(72) Inventors: Leon Hochman, West Bloomfield, MI (US); Nancy Valvona, West Bloomfield, MI (US); Stephen Nicolato, West Bloomfield, MI (US)

( * ) Notice: Subject to any disclaimer, the term of this patent is extended or adjusted under 35 U.S.C. 154(b) by 0 days.

(21) Appl. No.: 14/961,109

(22) Filed: Dec. 7, 2015

(65) Prior Publication Data

US 2016/0184157 A1 Jun. 30, 2016

Related U.S. Application Data

(60) Provisional application No. 62/087,835, filed on Dec. 5, 2014.

(51) Int. Cl.

| | |
|---|---|
| ***A61G 7/10*** | (2006.01) |
| ***A61G 13/10*** | (2006.01) |
| *A61G 7/05* | (2006.01) |

(52) U.S. Cl.

CPC ..... *A61G 7/1034* (2013.01); *A61G 7/1057* (2013.01); *A61G 13/10* (2013.01); *A61G 7/1046* (2013.01); *A61G 2007/0519* (2013.01)

(58) Field of Classification Search

CPC ..... A61G 1/02; A61G 7/005; A61G 7/1025; A61G 7/103; A61G 7/1034; A61G 7/1036; A61G 7/1046; A61G 7/057; A61G 7/05707; A61G 7/0573; A61G 7/1057; A61G 2007/0509; A61G 2007/0516; A61G 2007/0519; A61G 13/04; A61G 13/06; A61G 13/10; A61G 13/126; A61G 13/128; A47C 21/006; B65G 39/12; A61H 2201/0142; A61H 2201/5053

See application file for complete search history.

(56) References Cited

U.S. PATENT DOCUMENTS

| | | | | | |
|---|---|---|---|---|---|
| 2,909,173 | A * | 10/1959 | Anderson | A61H 15/0078 | 601/116 |
| 3,003,497 | A * | 10/1961 | Nunes | A61H 15/0078 | 601/116 |
| 3,205,887 | A * | 9/1965 | Henry | A61H 15/0078 | 601/116 |
| 3,541,617 | A * | 11/1970 | Clanan | A61G 7/1019 | 5/87.1 |
| 3,687,133 | A * | 8/1972 | Grubelic | A61H 15/0078 | 601/102 |
| 4,751,918 | A * | 6/1988 | Bernard | A61G 7/0573 | 5/933 |
| 5,855,207 | A * | 1/1999 | Moenning | A61G 7/015 | 128/845 |
| 6,190,338 | B1 * | 2/2001 | Arndt | A61H 1/00 | 601/102 |
| 7,762,966 | B1 * | 7/2010 | Gaines | A61H 15/0078 | 601/128 |
| 2013/0312191 | A1 * | 11/2013 | Szeinberg | A61G 7/0573 | 5/632 |

* cited by examiner

*Primary Examiner* — Nicholas Polito

(74) *Attorney, Agent, or Firm* — The Weintraub Group, P.L.C.

(57) ABSTRACT

A transporter table system for rollably transporting a patient between two support surfaces comprising a transporter table and a surgical table, wherein each table includes a table top, having a plate surface mounted atop with an array of openings, a plurality of rocker arms freely vertically movable within the table top, and an array of rollers rotatably mounted atop the plurality of rocker arms. The transporter system further comprises a locking mechanism for securing the transporter table to the surgical table during use and at least one motor within each of the tables for the purpose of adjusting the height and tilt of plurality of rocker arms and associated table tops.

12 Claims, 8 Drawing Sheets

TRANSPORTER TABLE SYSTEM

CROSS-REFERENCE TO RELATED APPLICATIONS

This application is a completion application of co-pending U.S. Provisional Patent Application Ser. No. 62/087,835 filed Dec. 5, 2014, for "Transporter Table System," the entire disclosure of which is hereby incorporated by reference in its entirety including the drawing.

BACKGROUND OF THE INVENTION

1. Field of the Invention

The present invention relates to a transporter table system for transporting a patient between a transporter table and a surgical table.

2. Description of Related Art

It is known to provide a transporter table system for minimizing the disturbance and handling of patients during their transfer from a transportable hospital bed or gurney to a surgical operations table. The handling of patients is minimized partly to minimize trauma to the patient and partly to minimize manual handling by hospital staff.

Some of the known surgical transfer systems comprise a patient transporter table in the form of a wheeled trolley or gurney which is readily maneuverable. The transporter table typically includes a table top, having a plate surface defining an upper surface, and a bed, for supporting the patient atop the table top. The bed is typically removably mounted onto the table top. The transporter table is rolled into position next to a surgical table and the patient is transferred, either to or from the surgical table. Unless appropriately locked together, the transporter table and the surgical table may separate and the patient accidentally dropped to the floor or the separation might cause discomfort during movement between and across the tables.

Surgical table transfer systems are known from U.S. Pat. No. 3,593,351 to Dove; U.S. Pat. No. 5,477,570 to Hannant et al.; U.S. Pat. No. 5,579,547 to Hunt; U.S. Pat. No. 7,181,791 to Clayton; U.S. Pat. Nos. 8,214,944 and 8,434,174 to Patterson, and U.S. Patent Publications Nos. 2007/0107122 to Georgi et al. and 2008/0034495 to Stidd et al. These known systems incorporate various arrangements for connecting beds together and transferring patients and are believed suitable for the purposes and problems they were intended to solve.

Of the above references, U.S. Pat. No. 8,214,944 to Clayton discloses a specific locking mechanism for a surgical table transfer system, but does not disclose rollers or the ability to tilt the patient for transfer. U.S. Patent Publication No. 2008/0034495 to Stidd et al. discloses different locking mechanisms, including a clamping system and the use of electromagnets, and transferring of patients, including the use of a transfer board. However, the top surface of the surgical table does not tilt. Further, the transfer board has wheels that allow the patient to roll, but the surgical table does not include a rolling mechanism.

These publications are identified herein in recognition of a duty of disclosure of related subject matter, which may be relevant under 37 CFR 1.56, and specifically incorporated, herein by reference as regards the conventional approaches and constructions taught therein.

While each of the above devices may have been suitable for the uses and problems the invention then intended to solve, none appreciated or suggest an arrangement according to this invention wherein: the beds are interlocked with one another while the patient is seamlessly transferred from one table to the other; the patient lies on a flex pad that slides on rollers on top of each table and laterally slides easily between the patient table tops; an array of rollers that may be extended from a retracted position below the patient table top and to a position above the table top; the rollers being dimensioned and adapted to project upwardly from the top face of the respective table surfaces when the patient is moved from one table to the other and lowered to "lock" the patient in position on the desired table; and a surgical table that can be tilted at a slight angle (e.g., 3° incline) relative to the transporter table to assist in sliding the patient from the surgical table to the transporter table.

It is to this to which the present invention is directed.

SUMMARY OF THE INVENTION

The present invention discloses a transporter table system of moving a patient between a transporter table and surgical table thereof.

According to this invention, there is disclosed a transporter table system comprising a stationary surgical table and a patient transporter table, the surgical table and transporter table each including a patient bed in the form of a table top having a plate surface mounted atop the plate surface for supporting a patient. The patient lays on top of the plate surface of the table top and atop a flex pad. The surgical table includes a support pedestal for supporting the table top thereon. The transporter table comprises a similar table top thereon supported by a support frame. The transporter table system further comprises, means for releasably locking corresponding mating sides of the surgical table and transporter table together, and means for tilting each table top of one table towards the table top of the other table.

Each table top further comprises an array of rollers rotatably mounted to a plurality of associated rocker arms disposed within the respective table top. Each array of rollers cooperating to form a planar support surface vertically movable above and below openings in the respective plate surface of the table top. Exposing the array of rollers through the openings in the plate surface facilitates in the lateral rolling movement of the flex pad between the table tops when transferring a patient between the surgical table and the transportable patient support.

Preferably, the tilting and raising of the rollers is effected when transferring a patient from one table top to the other, although the rollers may be used when the table tops are generally aligned to form a continuous horizontal patient support.

In a preferred embodiment, the means for releasably locking the tables comprises the transporter table having, arranged proximate to the table top thereof, a coupling element configured for selective releasable locking connection to the surgical table top. The coupling element locks to an associated pin release module within the surgical table top by way of a spring loaded locking pin disposed in the pin release module.

In a preferred arrangement, the means for tilting comprises a locator pin on each table top proximate the coupling element and pin release module, wherein coupling element includes first and second detents for receiving the respective locator pins when the table tops are interlocked.

Further, each table includes a plurality of rocker arms wherein each rocker arm includes an associated array of rollers. Each of the plurality of rocker arms are interconnected by a rocker shaft wherein an upper drive motor shaft, pivotally connected to the rocker shaft in a see-saw manner at one end and an upper motor within the support pedestal at an opposite end, facilitates vertical movement of the plurality of rocker arms and array of rollers. Once the plurality of rocker arms come into contact with the plate surface of the table top, any additional vertical movement pushes upwardly on the table top, wherein the locator pin on the surgical table, and connection between the coupling element and pin release module, causes the associated table to rotate and tilt.

Desirably, the table transport system includes means for positioning each array of rollers relative to the plate surface of its respective table top and from a first position, wherein each array of rollers is below the plate surface of its respective table top, and into a second position, wherein each array of rollers is above the plate surface of the respective table top. In the second position, the rollers are above the plate surface, the rollers allow the patient supported to be rolled between the surgical table and the transporter table or vice versa.

According to an aspect of this invention, the surgical table includes, within the support pedestal, an upper and lower drive motor. The upper drive motor includes an upper drive motor shaft interconnecting the upper drive motor to the rocker shaft below the plurality of rocker arms. The lower drive motor includes a lower drive motor shaft interconnecting the lower drive motor and a vertically movable outer portion of the support pedestal. The lower drive motor operates to move the outer portion of the support pedestal vertically, thus raising and lowering the entire table top and rocker arms. The upper drive motor operates to move the plurality of rocker arms and associated array of rollers vertically relative to the table top and into engagement with the flex pad. Once the array of rollers passes through the openings in the plate surface and the rocker arms engage the plate surface, the table top begins to tilt. Preferably, the tilt angle or angle of inclination of the table top is about 3°.

Additionally, each table may further comprise a drive arrangement for securing the flex pad in place atop the plate surface in order to prevent accidental rolling of the patient off of the table top. The drive arrangement includes a plurality of rack and pinion gears and associated stop plates, and means for rotating the gears and driving the plates in opposite directions to raise or lower the stop plates through stop plate openings on each side of the table top. When the stop plates are raised, the flex pad prevented from being rolled off a side of the table top.

These together with other aspects of the present invention, along with the various features of novelty that characterize the present invention, are pointed out with particularity in the claims annexed hereto and form a part of the present invention. For a better understanding of the present invention, its operating advantages, and the specific objects attained by its uses, reference should be made to the accompanying drawing and detailed description in which:

DETAILED DESCRIPTION OF THE INVENTION

Figure 1:
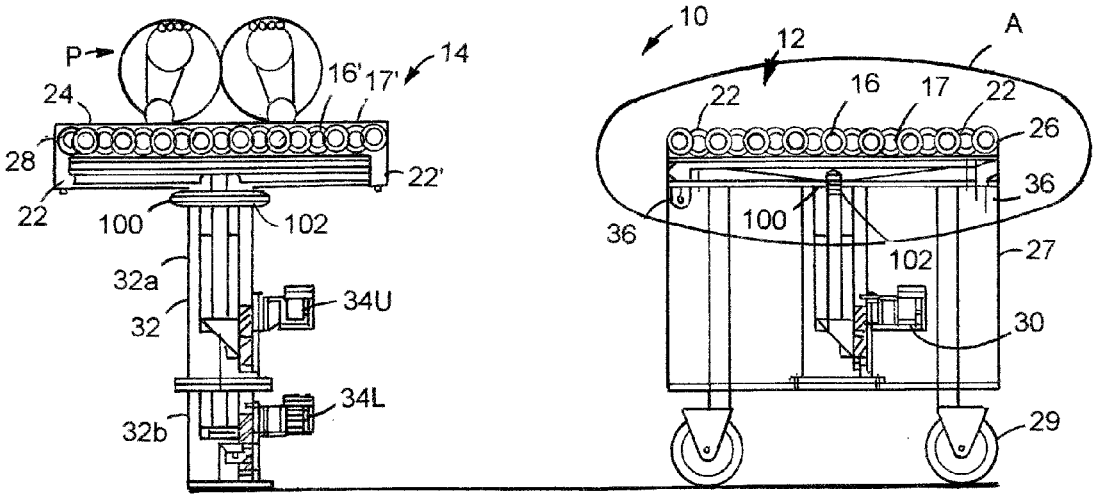
FIG. 1 is a side elevation view of a transporter table system with a patient atop a surgical table about to be transferred to a transporter table according to the present invention.

Turning now to the drawing, FIG. 1 illustrates a transporter table system 10 thereof. The transporter table system 10 includes a transporter table 12, such as a gurney, for transporting a hospital patient P thereon and for safely and conveniently transferring the patient P between the transporter table 12 and a stationary surgical table 14, such as a hospital operating room examination table or the like. The tables 12, 14 are longitudinally elongated and extend between head and foot ends. As shown, the patient P is resting atop the surgical table 14 and shows the foot end of the table. Respective longitudinal sides of the tables 12, 14 are positioned to be brought together and interlocked for patient transfer.

The transporter table 12 comprises a support frame 27 and an open top, hollowed body table top 26 pivotally coupled atop the support frame 27. Similarly, the surgical table 14 comprises a support pedestal 32 and an open top, hollowed body table top 28 pivotally coupled atop the support pedestal 32.

Figure 18:
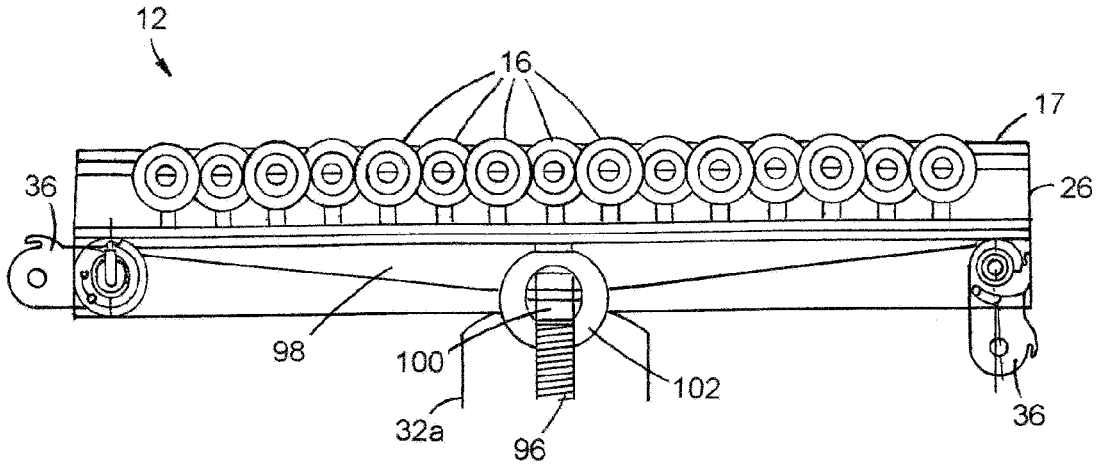
FIG. 18 is an enlarged detailed front view of the table top of the transporter table as shown in circle A in FIG. 1.

As shown in FIGS. 1 and 18, each table top 26, 28 of each table 12, 14, respectively, generally comprises the same structure, each including a plate surface 17, 17' formed over the open top of the respective table top 26, 28. Additionally, each table top 26, 28 includes a plurality of rocker arms 98 and an associated array of rollers 16, 16' rotatably mounted atop each of the plurality of rocker arms 98. The plurality of rocker arms 98 of each table top 26, 28 are interconnected by a rocker shaft 100 allowing for the plurality of rocker arms 98 to move vertically and in unison within the table top 26, 28, as discussed below.

Figure 14:
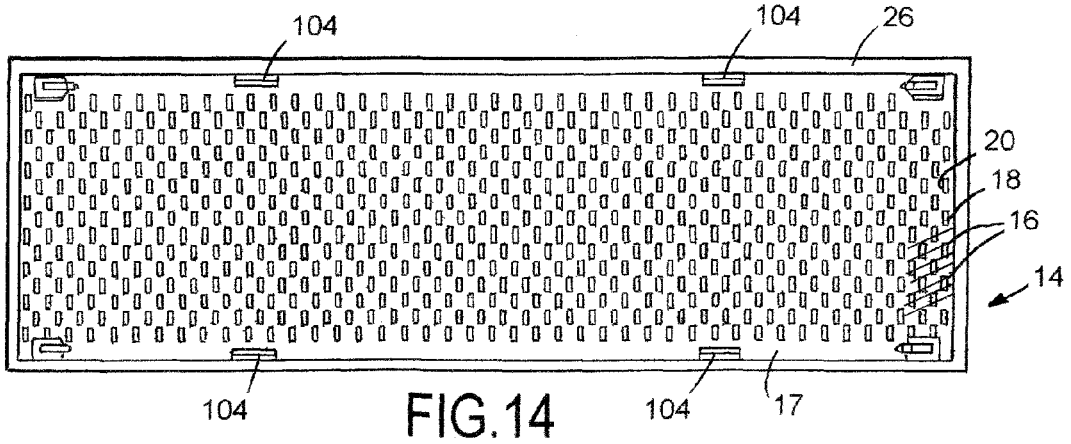
FIG. 14 is a plan view of the transporter table showing an array of openings on the plate surface and partially cut-away to show the array of rollers that are adapted to extend above and retract below the plate surface through the openings.

As shown in FIG. 14, a plate surface 17 of the table top 26 has an array of openings 20. The array of openings 20 are formed in the plate surface 17 and in alignment with the array of rollers 16 allowing the array the rollers 16, at least partially, to extend through the array of openings 20 during use. The table top 28 on the surgical table 14 comprises the same structure with an array of disc-like rollers 16' extending through an associated array of openings 20' formed within the plate surface 17' of the table top 28.

Figure 15:
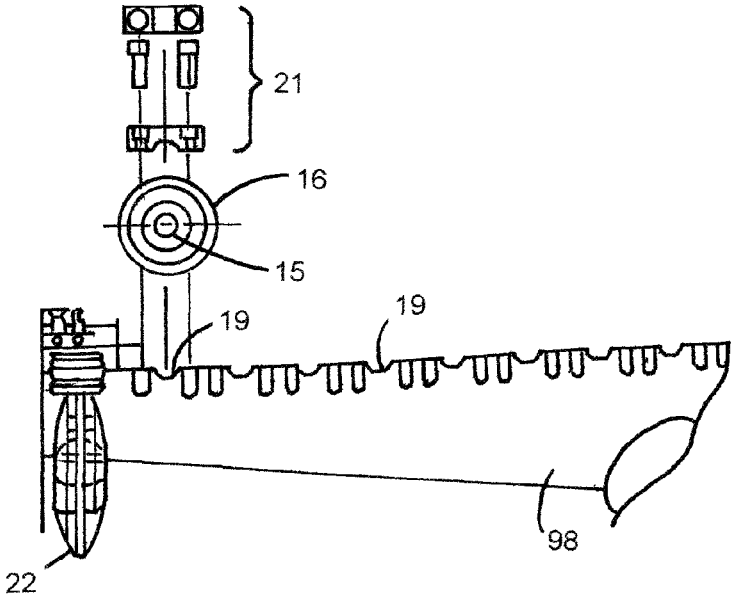
FIG. 15 is a partial view of a rocker arm and the mounting arrangement for the array of rollers.

As shown in FIG. 15, the rollers 16 are cylindrical and journaled for rotation about a respective axle 15 through a center of each of the rollers 16 and disposed in a respective cavity 19 of an associated rocker arm 98. Other arrangements for the rollers 16 are contemplated such as those including spherical balls.

During patient transfer, each of the plurality of rocker arms 98 of the transporter table 12 is raised by an associated motor, discussed below, in a manner such that the array of rollers 16, rotatably mounted to an associated rocker arm 98, extend through the openings 20 in the plate surface 17 of the table top 26.

Each of the plurality of rocker arms 98 are similarly raised in the table top 28 of the surgical table 14 such that the rollers 16' extend through the openings 20' of plate surface 17' during use. The extended portions of the array of rollers 16, 16' thereby form a substantially horizontal patient engaging surface for supporting the patient and upon which the patient P may roll across when being transferred laterally between the tables 12, 14. Alternatively, when patient movement is not desired, the rocker arms 98 of each table top 26, 28 are lowered such that the array of rollers 16, 16' retract below the openings 20, 20' of the plate surfaces 17, 17'.

The support frame 27 of the transporter table 12 includes a plurality of wheels 29 for rolling engagement with a floor surface. The support frame 27 further includes a first means for lifting the table top 26 and the plurality of rocker arms 98. The first means for lifting includes a drive motor 30 for adjusting the height of the table top 26 from the ground and also the angle of the table top 26 via a drive motor shaft 31.

Figure 16:
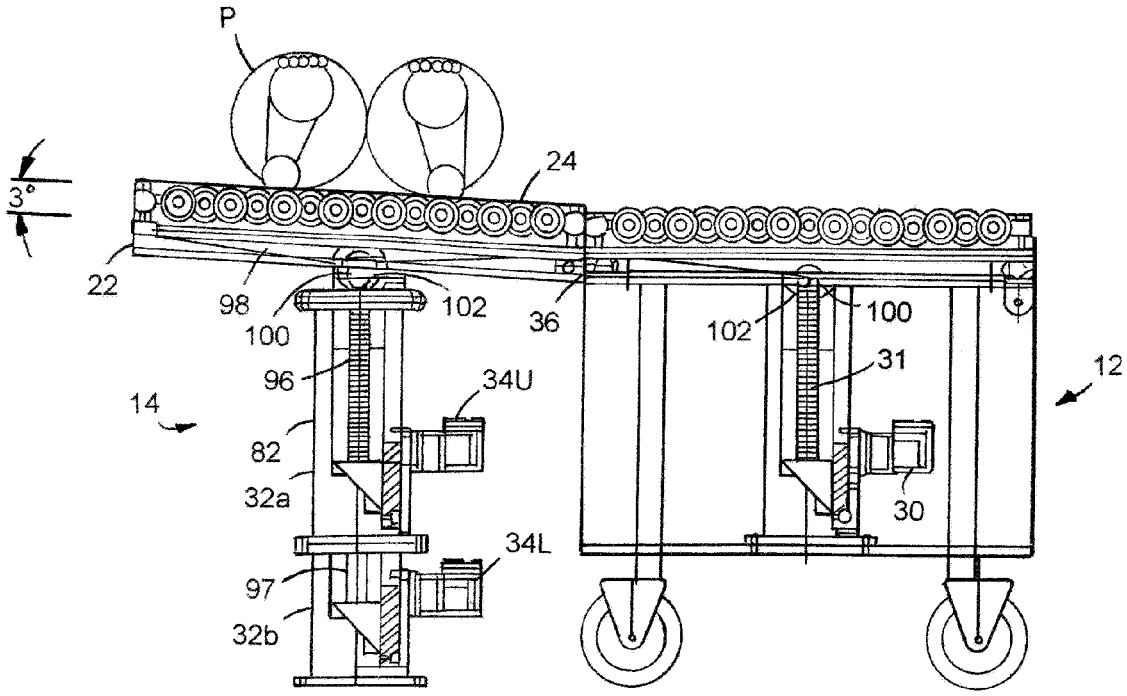
FIG. 16 is a side elevation view of the transporter table system with the surgical table and transporter table locked in place, the rocker arms and respective arrays of rollers raised, and the surgical table inclined at an angle to laterally transfer the patient from the surgical table to the transporter table.

As shown in FIG. 16, The stationary support pedestal 32 of the surgical table 14 comprises an upper portion 32*a* and a lower portion 32*b*. The lower portion 32*b* includes means for lifting the upper portion 32*a*. The means for lifting the upper portion 32*a* includes a lower drive motor 34L and a lower drive motor shaft 97 interconnecting the lower drive motor 34L to the upper portion 34*a* of the support pedestal 34. The lower drive motor 34L adjusts the height of the table top 28 from the ground by raising an upper portion 32*a* of the support pedestal 32. The upper portion 34*a* includes a means for lifting the table top 28 and plurality of rocker arms 98. The means for lifting the table top and plurality of rocker arms includes an upper drive motor 34U and an upper drive motor shaft 96. The upper drive motor 34U adjusts the angle of the table top 28 relative to the ground by raising the plurality of rocker arms 98 within the table top 28, further described below.

In use, the transporter table 12 is wheeled into position with the longer side of the transporter table 12 being positioned in abutting relation against the longer side of the surgical table 14. The height of the respective table top 26, 28 is adjusted by actuating the lower drive motor 34L, which raises and lowers the upper portion 34*a* of the support pedestal 34 so as to form a substantially continuous horizontal plane between table tops 26, 28 for laterally transferring the patient P.

The transporter table system 10 further comprises means for locking the tables 12, 14 to one another. The means for locking includes respective pairs of coupling elements 36, mounted on the table top 26 of the transporter table 12, and respective pairs of pin release modules 66 mounted within the table top 28 of the surgical table 14 when the table tops 26, 28 are in abutting relation.

As shown in FIG. 1, a first pair of coupling elements 36 are at the foot end of the transporter table 12. A like pair is provided at the head end of the transporter table 12 where the tables 12, 14 abut one another. The coupling element 36, proximate the surgical table 14, extends downwardly (i.e., oriented vertically) and not positioned for locking with the surgical table 14. As described below, once the coupling element 36 engages the surgical table 14, a plurality of second spring loaded locking pins 50 are manually adjusted to captivate and interlock the coupling elements 36 of the transporter table 12, thereby locking the table 12, 14.

As shown in FIGS. 2A-2C and 3A-3B, the locking arrangement on the transporter table 12 comprises the coupling elements 36 disposed proximate a side of the transporter table 12 and the second locking pins 50 retractably mounted within the pin release modules 66 of the surgical table 14. The pair of coupling elements 36 of the transporter table 12 are connected by an elongated longitudinally extending rod 40. The coupling elements 36 are generally planar or plate-like, including a first aperture 42, an opening 44, and a cam slot 46. The first aperture 42 is adapted to receive a first spring loaded locking pin 48 disposed within a pin release module 78 on the transporter table 12 and lock the coupling element 36 in vertical and horizontal positions, respectively.

The opening 44 is spaced at the distal end of the first aperture 42 and is adapted to receive the second spring loaded locking pin 50 disposed within the pin release module 66 of the surgical table 14. The cam slot 46 is adapted to receive opposite respective ends of the rod 40. The coupling element 36 also includes a second aperture 43 for receiving a mounting shaft 45 for mounting the coupling elements 36 to the transporter table 12.

Figure 2A:
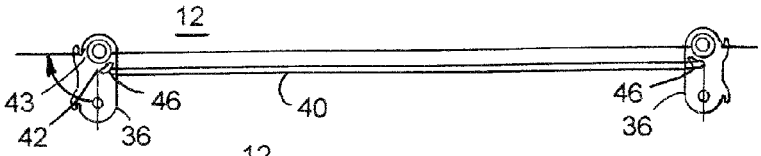
FIGS. 2A-2D are views showing a coupling element on the transporter table, the coupling element moving from an unlocked position and into a locked position wherein the coupling element is positioned for releasable locking with the surgical table.
Figure 2B:
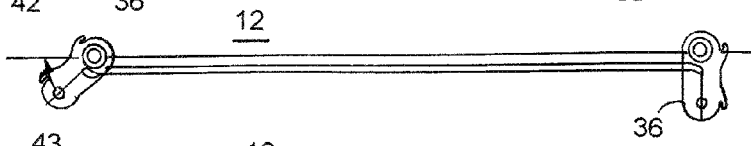
Figure 2C:
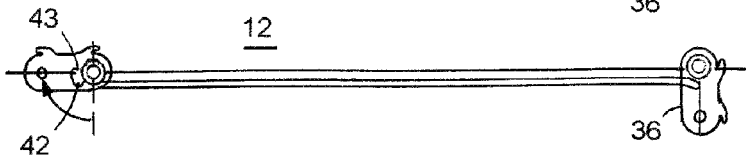
Figure 2D:
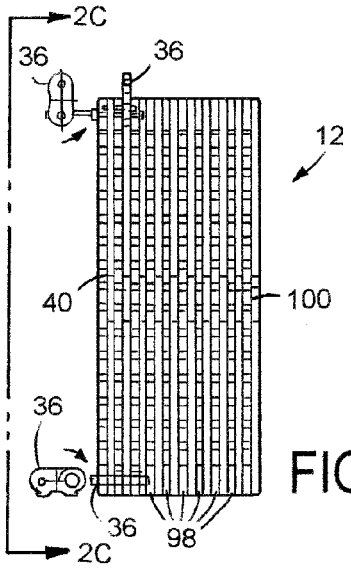
Figure 3A:
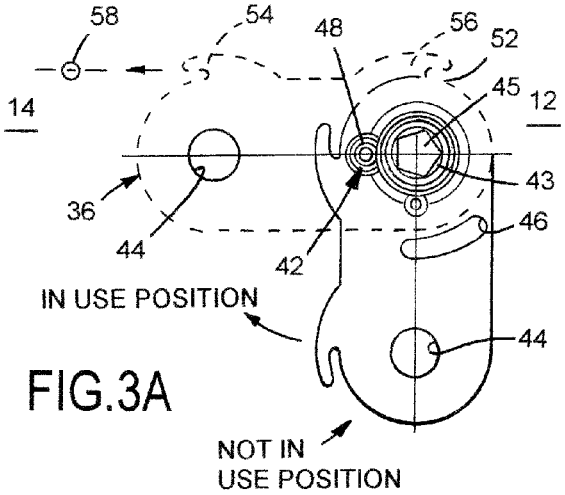
FIGS. 3A-3B are views of the coupling element shown in FIG. 2 in unlocked and locked positions, a first spring loaded locking pin for releasably retaining the coupling element in the locked position, and a first and second locator pin captivated in an associated first and second detent of the coupling element when rotated into the locked position.

In FIG. 3A, when not in use, the coupling elements 36 are initially directed downwardly. The first aperture 42 is shown vertically below the mounting shaft 45. When ready for use, the coupling elements 36 are manually rotated 90° from a vertical orientation (FIG. 2A and FIG. 3A) to a horizontal orientation (FIG. 2C and FIG. 3A). In FIG. 3A, the first aperture 42 is shown to the left of the mounting shaft 45 and the first locking pin 48 from the transporter table 12 is disposed in the first aperture 42, thereby locking the coupling elements 36 in a vertical disposition.

Figure 3B:
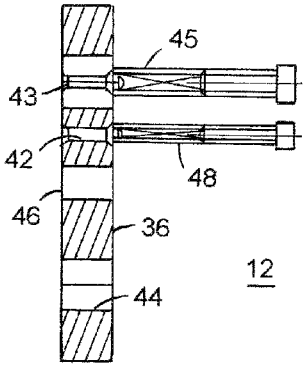

Further, according to an important aspect of this invention, and shown best by reference to FIGS. 3A-3B, the coupling element 36 includes a pair of oppositely directed detents, a first detent 52 and a second detent 54. The first detent 52 rotates into engagement with a first locator pin 56 on the transporter table 12 and the second detent 54 moves horizontally with the transporter table 12 and into engagement with a second locator pin 58 proximate the associated pin release module 66.

Importantly, as described below, the first and second locator pins 56, 58 provide, at least in part, a simple yet efficient manner for enabling the table top of one patient table to tilt downwardly towards the table top of the other patient table.

Figure 4:
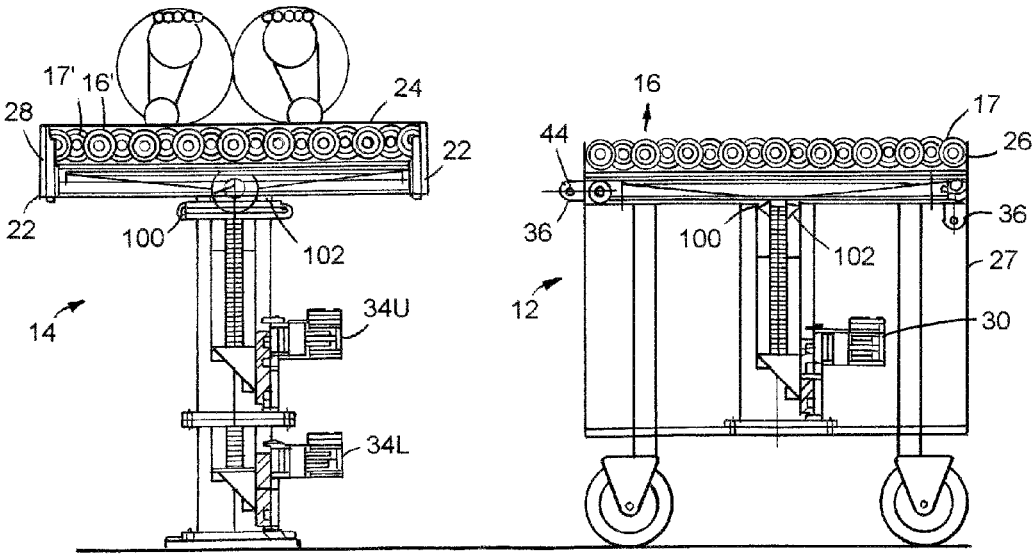
FIG. 4 is a side elevation view of the transporter table system with the tables positioned for interlocked relation with one another and with the coupling element of the transporter table positioned for interlocking with the surgical table.

FIG. 4 shows the tables 12, 14 positioned for interlocking and the coupling element 36 positioned for interlocking. When the coupling element 36 is in the horizontal position and in juxtaposition with the pin release module 66 thereof, the coupling element 36 is insertably situated within the pin release module 66 and the second locking pin 50, disposed within the pin release module 66, is inserted into the opening 44 of the coupling element 36 in order to lock the tables 12, 14 together.

Further, and importantly, the second locator pin 58 on the surgical table 14 is received in the second detent 54 of the coupling element 36. This catching of the second locator pin 58 with the coupling element 36, in addition to the second locking pin 50 extending within the coupling element 36, cooperates with upward movement by the upper drive motor 34U to allow the table top 28 of the surgical table 14 to tilt. The table top 28 tilts approximately 3° towards the transporter table 12 to allow the patient P to be easily laterally moved.

Figure 5:
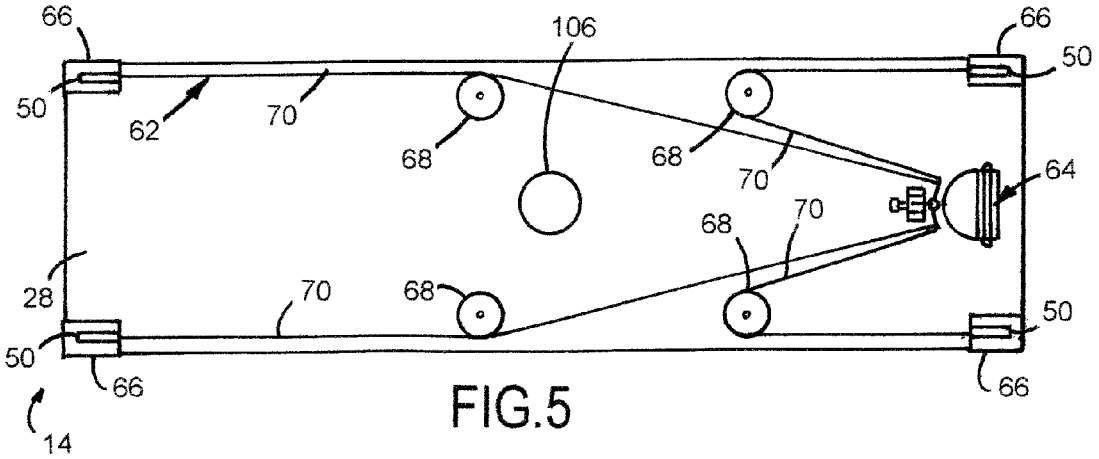
FIGS. 5 and 6 show the underside of the surgical table and a cable pulley system including a pull handle connected to a plurality of second spring loaded locking pins thereof for releasably retaining the coupling elements of the transporter table.
Figure 6:
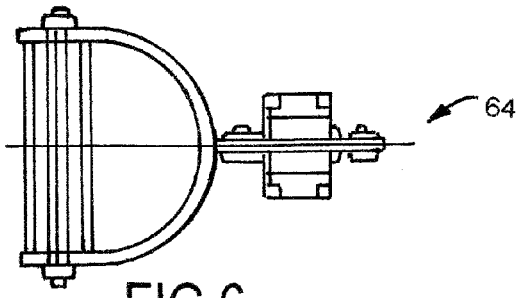
Figure 7:
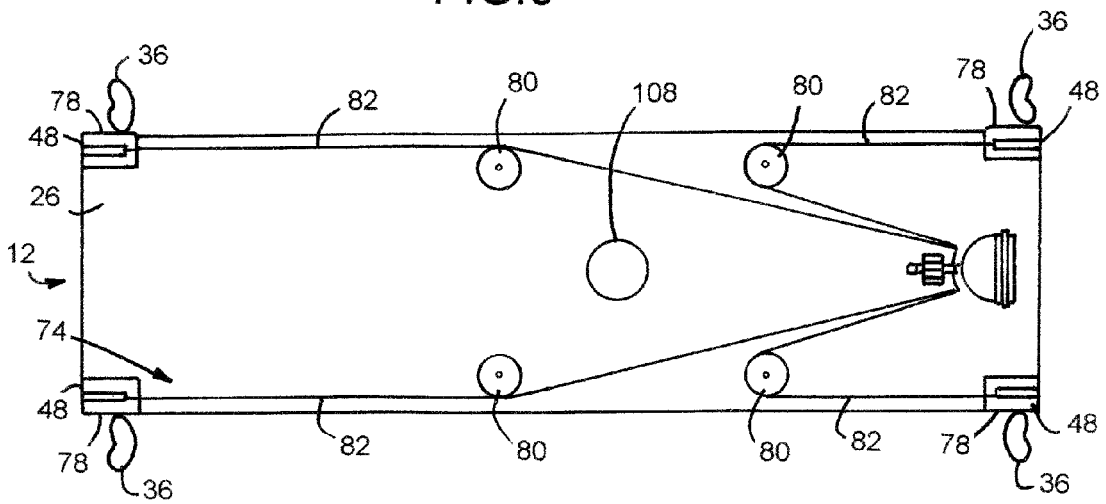
FIG. 7 shows the underside of the transporter table and a cable pulley system including a pull handle connected to all of the first spring loaded locking pins for releasing the coupling elements from their locked positions.

FIGS. 5-7 show similar manually operated cable pulley systems 62, 74 provided, respectively, on the surgical table 14 and the transporter table 12, respectively.

FIG. 5 is a plan view of the underside of the table top 28 of the surgical table 14 and a cable pulley system 62. The cable pulley system 62 includes a pull handle 64, a plurality of pin release modules 66, four of which are shown, with respective second locking pins 50, pulley blocks 68, and four respective cables 70 that connect the pull handle 64 to all of the pin release modules 66. The second locking pins 50 are received in the associated openings 44 of the coupling elements 36. A bore 106 is formed on the underside of the table top 28 for the upper drive motor shaft 96 to extend through the table top 28 and connect to the center portion 102. Therefore, the bore 106 need be placed directly underneath the center portion 102 allowing for a direct connection to raise the plurality of rocker arms 98.

The pull handle 64, shown in FIG. 6, is manually operated and allows the user to release the second locking pins 50 to insert the second locking pins 50 into the associated openings 44. Retracting the second locking pins 50 permits the coupling elements 36 to swivel to its horizontal and vertical position, thereby allowing the transporter table 12 to be rolled away from the surgical table 14. The pull handle 64 releases all four second locking pins 50 simultaneously.

Similarly, in FIG. 7, the underside of the table top 26 of the transporter table 12 has a similar cable pulley system 74 to that seen on the surgical table 14 including a pull handle 76, four pin release modules 78 with respective first locking pins 48, pulley blocks 80, and cables 82 that connect the pull handle 76 to all of the pin release modules 78. The pull handle 76 is manually operated and allows the user to release the first locking pins 48 to unlock and allow the coupling elements 36 to rotate from a horizontal in use position to a downward storage position. The pull handle 64 releases all four first locking pins 48 simultaneously. A bore 108 is also formed on the underside of the table top 26 allowing for the drive motor shaft 31 to extend through the table top 26 and connect to the center portion 102. Therefore, the bore 108 need be placed directly underneath the center portion 102 allowing for a direct connection to raise the plurality of rocker arms 98.

Figure 8:
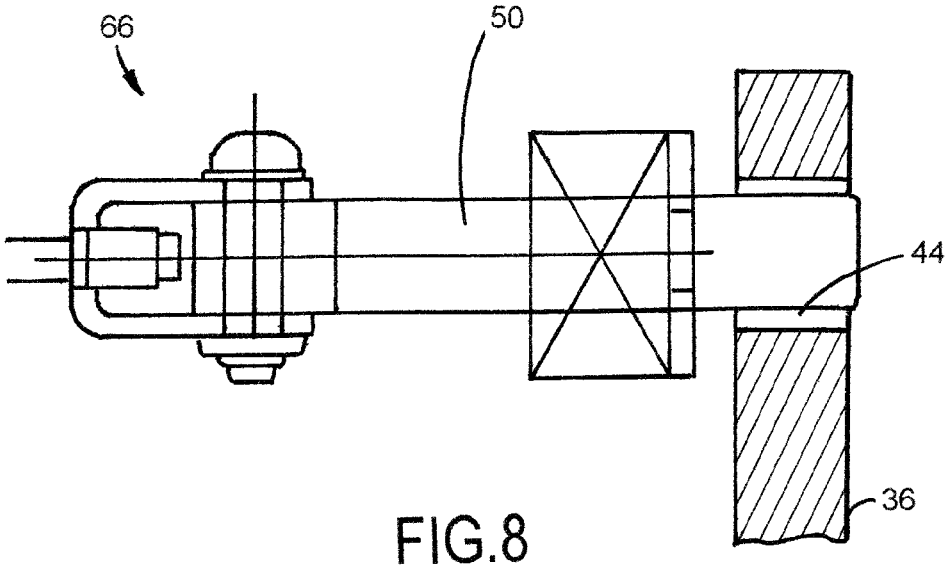
FIG. 8 shows a pin release module and second spring loaded locking pin of the surgical table that locks to the coupling element of the transporter table.

FIG. 8 shows detail of the pin release module 66 on the surgical table 14 with a respective second locking pin 50 received in the opening 44 of the coupling element 36 of the transporter table 12. The structure of the pin release modules 78 of the transporter table 12, including the first locking pins 48, functions the same as that of the pin release modules 66 of the surgical table 14.

Figure 9:
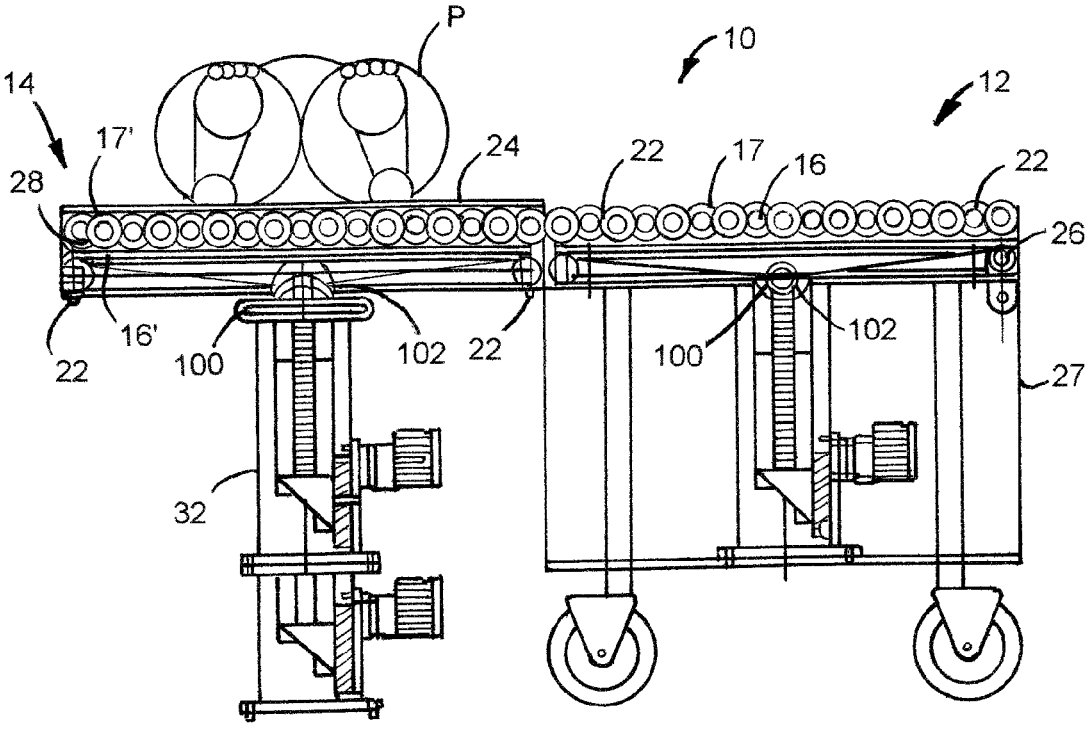
FIG. 9 is a side elevation view of the transporter table system with the surgical table and transporter table locked in place with the respective table tops aligned and forming a continuous horizontal patient support surface.

FIG. 9 shows the transporter table 12 locked to the surgical table 14 for transfer of the patient P from the surgical table 14 to the transporter table 12, and after the second locking pin 50 locks the coupling element 36 of the transporter table 12 to the surgical table 14.

Figure 19:
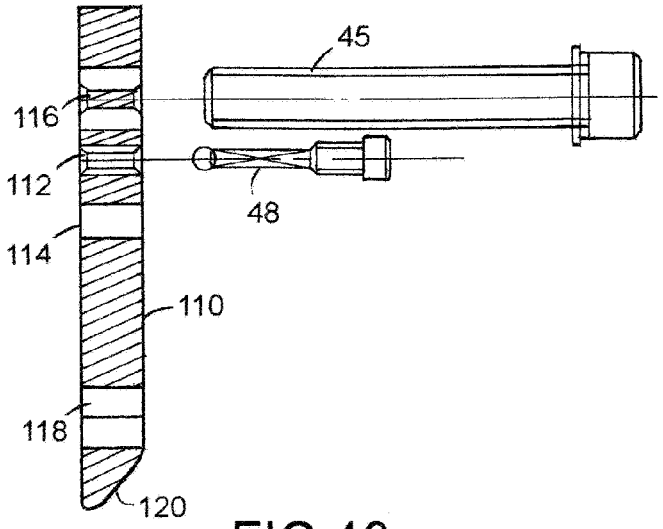
FIG. 19 is an alternative embodiment of the coupling element of the transporter table.

In an alternative embodiment, as shown in FIG. 19, a coupling element 110 of the transporter table 12 has a first aperture 112, a cam slot 114, a second aperture 116, and an opening 118. The first aperture 112 allows for the insertion of the first locking pin 48 from an associated pin locking module 78, thereby locking the coupling element 110 in either a vertical or horizontal position. The cam slot 114 is adapted to receive opposite respective ends of the rod 40, which interconnects opposite coupling elements 110. The second aperture 116 provides for rotatably attachment of the mounting shaft 45 against the table top 26 of the transporter table 12. The opening 118 permits for the coupling element 110 to lock to the table top 28 of the surgical table 14 as the second locking pin 50 extends from within an associated pin locking module 66. The coupling element 110 also has toe 120 at an end opposite the second aperture 116, which is angled. The angle of the toe 120 allows for the coupling element 110 to engage the second locking pin 50 without having to activate the pull handle 64 and manually retract the second locking pins 50 prior to engagement as described above.

FIG. 14 shows a plan view of the table top 26, the openings 20 in the plate surface 17, and respective passages 18 to show, in part, the array of rollers 16 adapted to move relative to their respective passages 18 and extend above and retract below the plate surface 17.

FIG. 15 shows a partial end elevation view of the transporter table 12 and the mounting arrangement for the array of rollers 16. The array of rollers 16 are separately journaled on their axle 15 and nested within the respective cavity 19 of the plurality of rocker arms 98. A clamping arrangement 21 separately secures each array of rollers 16 to an associated rocker arm 98.

While the vertical movement of the plurality of rocker arms 98 and array of rollers 16, 16' of the surgical table 14 and transporter table 12, respectively, are the same, all reference will be made as to the vertical movement within the surgical table 14 and it is to be understood that the transporter table 12 exhibits the same structure. In order to raise the array of rollers 16' through the openings 20' in the plate surface 17' of the table top 28, a central pivot 102 is mounted to the top of the upper drive motor shaft 96 and pivotally connected to the rocker shaft 100. Therefore, as the upper drive motor 34U is activated and raises the central pivot 102, the plurality of rocker arms 98 are similarly moved upwardly within the table top 28.

As noted above, the array of rollers 16' are rotatably mounted atop each of the associated rocker arm 98 and, as the plurality of rocker arms 98 are driven upwardly, the array of rollers 16' are also driven upwardly, thereby extending through the openings 20' of the plate surface 17'. The array of rollers 16' extend through the openings 20' until a point at which the plurality of rocker arms 98 comes into contact with the plate surface 17' and additional lifting force by the upper drive motor 34U pushes upwardly on the plate surface 17'.

Due to the locking arrangement between the coupling element 36 and the pin release module 66 of the table top 28, the table top 28 is restricted from remaining in parallel position with the floor surface as it moves upwardly. Therefore, upward force by the drive motor shaft 96 causes the table top 28 to pivot with the plurality of rocker arms 98, which is pivotally connected to the central pivot 102 via the rocker shaft 100. Each of the plurality of rocker arms 98 simultaneously pivots about the central pivot 102 in light of the rocker shaft 100 extending along the length of the tables 12, 14 and the plurality of rocker arms 98 being journaled onto the rocker shaft 100. As a result, the surgical table 14 becomes inclined at an angle and tilts downwardly in the direction of the transporter table 12. This allows for the movement of the patient P on a flex pad 24 atop the plate surface 17' with minimum effort and very little disturbance to the patient P.

FIG. 16 is a partial end elevation view of the transporter table system 10 with the surgical table 14 and transporter table 12 locked in place. The plurality of rockers 98 are raised to a point wherein the array of rollers 16' are extended through the openings 20' of the plate surface 17, thus exerting force on the plate surface 17' and tilting the table top 28 towards the transporter table 12.

Preferably, the tilt angle is about 3°. Depending on the table configurations, supporting extension of the rollers, and table bedding, and a number of other factors, the angle could be between 2° to 5°.

Once the patient P is moved, the upper drive motor 34U operates in a reverse direction in order to lower both the plurality of rocker arms 98, with its associated array of rollers 16', and the table top 28 to its original horizontal position. Lastly, once the table top 28 is fully horizontal and the plurality of rocker arms 98 separate from the plate surface 17', the plurality of rocker arms 98 continue to lower, thus retracting the array of rollers 16' from the openings 20' of the plate surface 17'.

As shown in FIG. 1, the transporter table 12 and surgical table 14 includes a means for retaining the flex pad 24 in position above the plate surfaces 17, 17', respectively. The means for retaining the flex pad 24 comprises a pair of stop handles 22 shown in a horizontal position on the transporter table 12, and a like pair of stop handles 22' in a vertical position on the surgical table 14. As discussed below, the stop handles 22, 22' are secured to the table top 26, 28, respectively, and have the same function, namely, to raise or lower a plurality of stop plates 94 in order to retain the flex pad 24 in position and prevent the patient P from accidentally rolling off the table tops 26, 28.

Figure 10:
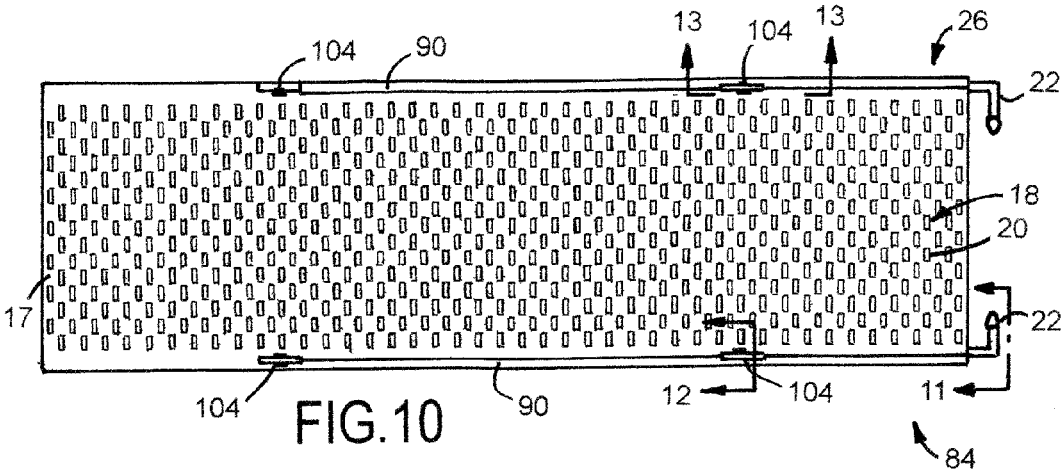
FIG. 10 shows a pair of stop handles wherein a stop handle on each side of the transporter table and surgical table rotates and its connection to a rack and pinion drive arrangement operates to raise or lower a plurality of stop plates on sides of the table to which it is connected.

FIGS. 10 and 11 show the means for retaining the flex pad 24 in position. The means for retaining preferably comprises a drive arrangement 84 including the pair of stop handles 22 rotatably mounted on each side of the table top 26, 28, which moves the plurality of stop plates 94 extending upwardly or downwardly through stop plate openings 104 proximate the sides of the top plates 17, 17'. The discussion is applicable to both tables 12, 14 as each includes the same relevant elements. For the purposes herein, the discussion will initially refer to the transporter table 12.

Figure 13A:
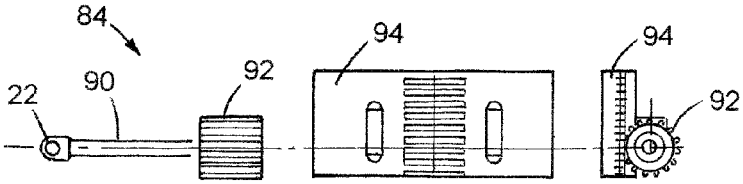
FIGS. 13A and 13B are views taken along line 13-13 of FIG. 10 showing the drive arrangement wherein FIG. 13A corresponds to FIGS. 11A and 12A and demonstrates the stop plates raised and wherein FIG. 13B corresponds to FIGS. 11E and 12E and demonstrates the stop plates lowered.
Figure 13B:
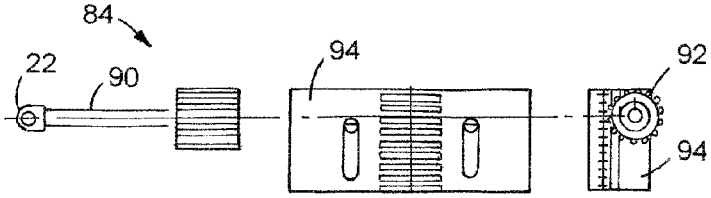

FIG. 10 is a plan view of the plate surface 17 of the transporter table 12 and shows the pair of stop handles 22 mounted for rotation at the foot end of the transporter table 12 on the table top 26. As shown in FIGS. 13A and 13B, the drive arrangement 84 is in the nature of a rack and pinion drive and includes a rotatable stop handle drive shaft 90, a toothed gear wheel 92, and a linear toothed stop plate 94. The stop handle 22 is connected to one end of the stop handle drive shaft 90. The gear wheel 92 is mounted for rotation to the stop handle drive shaft 90, located between opposite ends thereof, and a plurality of teeth on the gear wheels 92 engage corresponding teeth on a respective stop plate 94. Rotation of the stop handles 22 cause the stop handle drive shaft 90 and the gear wheel 92 to rotate and the stop plates 94 to move vertically.

Figure 11A:
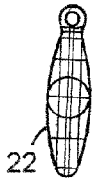
FIGS. 11A-11E are views taken along lines 11-11 in FIG. 10 showing the stop handle positions as the stop handle rotates.
Figure 11B:
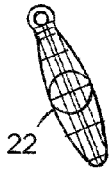
Figure 11C:
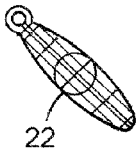
Figure 11D:
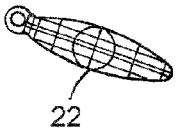
Figure 11E:
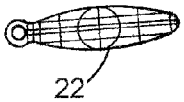
Figure 12A:
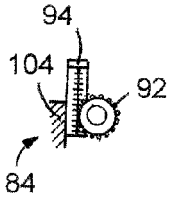
FIGS. 12A-12E are views taken along lines 12-12 in FIG. 10 showing the drive arrangement and stop plate positions corresponding to the rotation of the stop handle shown in corresponding FIGS. 11A-11E.
Figure 12B:
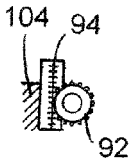
Figure 12C:
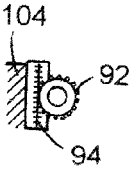
Figure 12D:
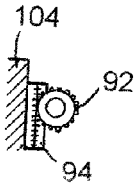
Figure 12E:
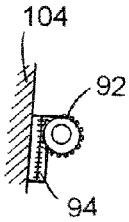

In FIG. 13A, which corresponds to FIGS. 11A and 12A, the stop handle 22 is in the vertical position and the stop plates 94 are raised. In FIG. 13B, which corresponds to FIGS. 11E and 12E, the stop handle 22 has rotated 90° and the stop plates 94 have been lowered. FIGS. 11A-11E show rotational positions of the stop handle 22 relative to the gear wheel 92 engaged with the stop plate 94. The succession of views is best understood by reference to FIG. 10 and the two views taken along line 11-11, for the stop handle 22, and line 12-12, for the stop plate 94 being raised and lowered relative to the gear wheel 92. The views show the orientation of the gear wheel 92 and the downward movement of the stop plate 94 resulting from rotation of the stop handle 22 Reverse rotation of the stop handle 22 causes the gear wheel 82 to rotate in an opposite direction to move stop plate 94 upwardly through the associated stop plate openings 104 in the plate surface 17.

Rotation of the stop handles 22 from a vertical position to a horizontal position causes the stop plates 94 to from move downwardly, thus retracting the stop plates 94 from the stop plate openings 104 in the plate surface 17 and allowing the flex pad 24 and patient P to be moved between tables 12, 14. Alternatively, rotating the stop handles 22 back to a vertical position extends the stop plates 94 upwardly through the stop plate openings 104 in the plate surface 17. While FIG. 10 shows two stop plate openings 104 on each side of the plate surface 17, there can be any number of stop plate openings 104 ranging in size. Similarly, the stop plates 94 themselves can range in any number of sizes fitting within the associated stop plate 94, with each stop plate 94 having an associated gear wheel 92.

Although not shown, the surgical table 14 comprises the same configuration of gear wheels and stop plates working in unison with the stop handles 22' in order to move the associated stop plates up and down, thereby either securing the flex pad 24 or allowing for the flex pad 24 to be moved onto the surgical table 14.

Figure 17:
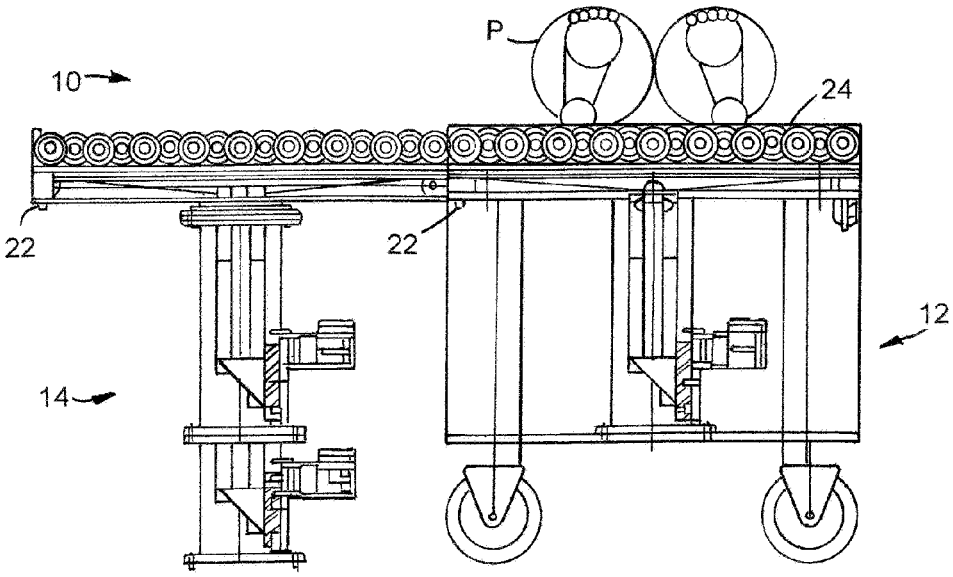
FIG. 17 is a side elevation view of the transporter table system with the surgical table and transporter table locked in place and after the patient has been laterally transferred from the surgical table to the transporter table.

FIG. 17 is a side elevation view of the transporter table system 10 with the surgical table 14 and transporter table 12 locked in place and the stop plates 94 retracted, allowing the patient P to be laterally transferred atop the rollers 16, 16' and from the surgical table 14 to the transporter table 12.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching.

Having thus described the present invention, what is claimed is:

LIST OF REFERENCE NUMBERS

10 Transporter table system
12 Transporter table
14 Surgical table
15 Axle of rollers
16 Rollers on transporter table
16' Rollers on surgical table
17 Plate surface on transporter table
17' Plate surface on surgical table
18 Passages on transporter table
18' Passages on surgical table
19 Cavity for rollers on transporter table
19' Cavity for rollers on surgical table
20 Openings on transporter table
20' Openings on surgical table
21 Clamping arrangement
22 Stop handle on transporter table
22' Stop handle on surgical table
24 Flex pad
26 Table top of transporter table
27 Support frame
28 Table top of surgical table
29 Wheels
30 Drive motor
31 Drive motor shaft
32 Support pedestal
32*a* Upper portion of support pedestal
32*b* Lower portion of support pedestal
34L Lower drive motor
34U Upper drive motor
36 Coupling element
40 Rod
42 First aperture
43 Second aperture
44 Opening
45 Mounting shaft
46 Cam slot
48 First locking pin
50 Second locking pin
52 First detent
54 Second detent
56 First locator pin
58 Second locator pin
62 Cable pulley system
64 Pull handle
66 Pin release module
68 Pulley block
70 Cables
74 Cable pulley system
76 Pull handle
78 Pin release module
80 Pulley block
82 Cables
84 Drive arrangement
90 Stop handle drive shaft
92 Gear wheel
94 Stop plate
96 Upper drive motor shaft
97 Lower drive motor shaft
98 Rocker arm
100 Rocker shaft
102 Central pivot
104 Stop plate opening
106 Bore of surgical table
108 Bore of transporter table
110 Coupling element
112 First aperture
114 Cam slot
116 Second aperture
118 Opening
120 Toe
P Patient

Having thus described the present invention, what is claimed is:

1. A transporter table system comprising:

(a) a transporter table including:

(i) a support frame having a top, a bottom, and an interior cavity;

(ii) a first table top situated on the top of the support frame, the first table top having a first plate surface mounted atop the first table top including a plurality of first openings formed therein;

(iii) a plurality of first rocker arms disposed and movable within the first table top;

(iv) a first rocker shaft longitudinally extending substantially the entire length of the first table top, each of the plurality of first rocker arms being spaced apart and journaled onto the first rocker shaft;

(v) a first array of rollers rotatably mounted atop each of the plurality of first rocker arms, the first array of rollers being in registry and below the plurality of first openings of the first plate surface;

(vi) means for lifting the plurality of first rocker arms;

(vii) wherein the first table top tilts as the means for lifting the plurality of first rocker arms is actuated and the plurality of first rocker arms comes into contact with the first table top;

(b) a surgical table including:

(i) a support pedestal having an upper support pedestal portion and a lower support pedestal portion, the upper and lower support pedestal portions each having a top, a bottom, and an interior cavity, the upper pedestal portion vertically movable within the lower support pedestal portion;

(ii) a second table top situated on the top of the upper support pedestal portion, the second table top having a second plate surface mounted atop the second table top including a plurality of second openings formed therein;

(iii) a plurality of second rocker arms disposed and moveable within the second table top;

(iv) a second rocker shaft longitudinally extending substantially the entire length of the second table top, each of the plurality of second rocker arms being spaced apart and journaled onto the second rocker shaft;

(v) a second array of rollers rotatably mounted atop each of the plurality of second rocker arms, the second array of rollers being in registry and below the plurality of second openings of the second plate surface;

(vi) means for lifting the upper support pedestal portion;

(vii) means for lifting the plurality of second rocker arms; and (viii) wherein the second table top tilts as the means for lifting the plurality of second rocker arms is actuated and the plurality of second rocker arms comes into contact with the second table top.

2. The transporter table system of claim 1 wherein the means for lifting the plurality of first rocker arms comprises:

(a) a drive motor mounted within the interior cavity of the support frame;

(b) a drive motor shaft having a first end and a second end, the drive motor shaft connected to the drive motor at the first end; and (c) a first central pivot, the first central pivot being mounted to the drive motor shaft at the second end, the first rocker shaft being pivotally connected to the first central pivot.

3. The transporter table system of claim 1 wherein the means for lifting the upper support pedestal portion comprises:

(a) a lower drive motor mounted within the interior cavity of the lower support pedestal portion; and (b) a lower drive motor shaft having a first end and a second end, the lower drive motor shaft connected to the lower drive motor at the first end, the upper support pedestal portion connected to the lower drive motor shaft at the second end.

4. The transporter table system of claim 1 wherein the means for lifting the plurality of second rocker arms comprises:

(a) an upper drive motor mounted within the interior cavity of the upper support pedestal portion;

(b) an upper drive motor shaft having a first end and a second end, the upper drive motor shaft connected to the upper drive motor at the first end; and (c) a second central pivot, the second central pivot being mounted to the upper drive motor shaft at the second end, the second rocker shaft being pivotally connected to the second central pivot.

5. The transporter table system of claim 1 further comprising a flex pad movable between the first plate surface or the second plate surface.

6. The transporter table system of claim 5 further comprising:

(a) means for retaining the flex pad atop the first plate surface; and (b) means for retaining the flex pad atop the second plate surface.

7. The transporter table system of claim 6 wherein the means for retaining the flex pad atop the first plate surface comprises a first drive arrangement, the first drive arrangement including:

(a) a pair of first stop handles rotatably mounted to the first table top, each of the first stop handles having a first stop handle drive shaft connected to an end of each of the first stop handles and extending along opposing sides of the first table top;

(b) at least one first gear wheel axially mounted on each of the first stop handle drive shafts;

(c) at least one first stop plate vertically movable on opposing sides of the first plate surface, each of the at least one first stop plates corresponding to an associated first gear wheel and in mechanical communication therewith, wherein each of the at least one first stop plates are raised and lowered when the first stop handles are turned in respective directions.

8. The transporter table system of claim 6 wherein the means for retaining the flex pad atop of second plate surface comprises a second drive arrangement, the second drive arrangement including:

(a) a pair of second stop handles rotatably mounted to the second table top, each of the second stop handles having a second stop handle drive shaft connected to an end of each of the second stop handles and extending along opposing sides of the second table top;

(b) at least one second gear wheel axially mounted on each of the second stop handle drive shafts;

(c) at least one second stop plate vertically movable on opposing sides of the second plate surface, each of the at least one second stop plates corresponding to an associated second gear wheel and in mechanical communication therewith, wherein each of the at least one second stop plates are raised and lowered when the second stop handles are turned in respective directions.

9. The transporter table of claim 1 further comprising means for locking the transporter table to the surgical table.

10. The transporter table system of claim 9 wherein the means for locking further comprises:

(a) at least one pair of coupling elements rotatably mounted to opposing ends of the first table top and interconnected by a first rod extending along a side of the transporter table;

(b) at least one pair of first spring loaded locking pins, each of the at least one pair of locking pins securing an associated coupling element in a horizontal and vertical position;

(c) at least one pair of second spring loaded locking pins, each of the at least one pair of second locking pins securing an associated coupling element in a horizontal position to the second table top.

11. The transporter table system of claim 10 further comprising:

(a) a first pull handle mounted below the first table top in communication with each of the first locking pins by a plurality of first cables, wherein pulling the first pull handle releases each of the first locking pins from engagement with the coupling elements; and (b) a second pull handle mounted below the second table top in communication with each of the second locking pins by a plurality of second cables, wherein pulling the second pull handle releases each of the second locking pins from engagement with the coupling elements.

12. The transporter table system of claim 10 wherein each of the coupling elements further comprises:

(a) a first detent engaging a first locator pin when each of the coupling elements are in the horizontal position, the first locator pin disposed on the first table top; and (b) a second detent engaging a second locator pin when each of the coupling elements are in the horizontal position and the transporter table and surgical table are abutted against, the second locator pin disposed on the second table top proximate the second locking pin.

* * * * *